US007556016B2

(12) United States Patent
Kraus et al.

(10) Patent No.: US 7,556,016 B2
(45) Date of Patent: Jul. 7, 2009

(54) METHOD AND DEVICE FOR OPERATING AN INTERNAL COMBUSTION ENGINE

(75) Inventors: Markus Kraus, Reifenthal (DE); Kai Wollenschläger, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 87 days.

(21) Appl. No.: 11/796,722

(22) Filed: Apr. 27, 2007

(65) Prior Publication Data

US 2007/0272210 A1 Nov. 29, 2007

(51) Int. Cl.
*F02B 17/00* (2006.01)

(52) U.S. Cl. ..... 123/295; 123/479; 123/672; 123/690

(58) Field of Classification Search ..... 123/295, 123/479, 672, 690
See application file for complete search history.

(56) References Cited

U.S. PATENT DOCUMENTS 5,896,839 A * 4/1999 Togai ..... 123/295
6,032,639 A * 3/2000 Goto et al. ..... 123/295

FOREIGN PATENT DOCUMENTS

| | | | |
|---|---|---|---|
| DE | 19900740 | A1 | 7/2000 |
| DE | 199 46 962 | C1 | 1/2001 |
| DE | 19946962 | C1 | 1/2001 |

* cited by examiner

*Primary Examiner*—Erick Solis
(74) *Attorney, Agent, or Firm*—King & Spalding L.L.P.

(57) ABSTRACT

In order to operate an internal combustion engine, a value of an operating variable of the internal combustion engine is determined depending on at least one measured quantity of the internal combustion engine. A test is carried out to determine whether or not the value of the operating variable is plausible depending on at least one second measured quantity of the internal combustion engine. If the value of the operating variable is implausible, a test is carried out to determine whether or not the internal combustion engine is currently being operated in lean operation. If the internal combustion engine is currently being operated in lean operation, a changeover to the quasi-stoichiometric operation of the internal combustion engine is implemented. After the changeover to the quasi-stoichiometric operation, the value of the operating variable is determined anew and tested anew. A changeover to lean operation is carried out anew if the newly determined value of the operating variable is plausible.

12 Claims, 2 Drawing Sheets

METHOD AND DEVICE FOR OPERATING AN INTERNAL COMBUSTION ENGINE

CROSS REFERENCE TO RELATED APPLICATIONS

This application claims priority of German application No. 10 2006 022 106.0 DE filed May 11, 2006, which is incorporated by reference herein in its entirety.

FIELD OF INVENTION

The invention relates to a method and a device for operating an internal combustion engine. The internal combustion engine comprises an intake tract, which communicates with a combustion chamber of a cylinder of the internal combustion engine depending on the position of a gas intake valve. At least one final control element is arranged in the intake tract, by means of which a mass air flow through the combustion chamber can be specified. The internal combustion engine comprises an injection valve for metering the fuel that is allocated to the cylinder.

BACKGROUND OF INVENTION

The Association of the German Automotive Industry (VDA) has proposed a standardized e-gas monitoring concept for the engine control of gasoline and diesel engines. The e-gas monitoring concept makes provision for the fact that in lean operation of an internal combustion engine, it is necessary to change over irreversibly to quasi-stoichiometric operation of the internal combustion engine when an implausible operating variable of the internal combustion engine occurs.

The effects of the implausible operating variable during the quasi-stoichiometric operation of the internal combustion engine are normally less critical than possible effects of the implausible operating variables in lean operation of the internal combustion engine. However, the efficiency of the internal combustion engine is higher in lean operation than that of the quasi-stoichiometric operation.

SUMMARY OF INVENTION

An object of the invention is to create a method and a device for operating an internal combustion engine which respectively ensure a highly efficient operation of the internal combustion engine.

The invention is characterized by a method and a corresponding device for operating an internal combustion engine. The internal combustion engine comprises an intake tract, at least one final control element and an injection valve for dispensing fuel. The intake tract communicates with a combustion chamber of a cylinder of the internal combustion engine depending on the position of a gas intake valve. The final control element is arranged in the intake tract. A mass air flow through to the combustion chamber can be specified by the final control element. The injection valve is allocated to the cylinder. In order to operate the internal combustion engine, a value of an operating variable of the internal combustion engine is determined as a function of at least one first measured quantity of the internal combustion engine. A test is carried out to determine whether or not the value of the operating variable is plausible as a function of at least a second measured quantity of the internal combustion engine. If the value of the operating variable is not plausible, a test is carried out to determine whether or not the internal combustion engine is currently being operated in lean operation. If the internal combustion engine is currently being operated in lean operation, the operation is changed over to quasi-stoichiometric operation of the internal combustion engine. After the changeover to quasi-stoichiometric operation, the value of the operating variable is determined anew and tested anew. A changeover to lean operation takes place if the newly determined value of the operating variable is plausible.

In lean operation, a mass air flow up to the combustion chamber is preferably adjusted in an unthrottled manner and a load of the internal combustion engine is adjusted by using an amount of fuel to be dispensed. In addition to lean operation, the load of the internal combustion engine is preferably adjusted by throttling the mass air flow up through the combustion chamber. Therefore, in the case of lean operation of the internal combustion engine an efficiency of the internal combustion engine is higher than that of the quasi-stoichiometric operation of the internal combustion engine. The improved efficiency of the internal combustion engine results in a lower fuel consumption of the internal combustion engine. However, should an error condition occur there is a risk that a fluctuation in the torque generated by the internal combustion engine is greater than during the quasi-stoichiometric operation. If the value of the operating variable is implausible and thus an error condition occurs, the internal combustion engine is therefore operated in quasi-stoichiometric operation and at a lower efficiency to avoid a fluctuation in the torque. Changing over to lean operation in the case of a plausible operating variable thus makes it possible for the internal combustion engine only to be operated at a lower efficiency for as long as the error condition is present. This contributes to highly-efficient operation of the internal combustion engine.

It is for example possible to test whether or not the value of the operating variable is plausible by determining a check value of the operating variable as a function of a second measured quantity and by comparing the check value to the value of the operating variable. It is for example possible to specify a tolerance band as a function of the second measured quantity and/or the check value of the operating variable. In order to test the value of the operating variable, a test is now carried out to determine whether or not the value of the operating variable lies within the tolerance band. Alternatively, the tolerance band can be predetermined around the value of the operating variable and, to make the check, a test is carried out to determine whether or not the check value of the operating variable lies within the tolerance band.

In lean operation of the internal combustion engine, less fuel is dispensed to the internal combustion engine for a combustion process than can be combusted with an amount of air fed into said internal combustion engine for the combustion process. During stoichiometric operation of the internal combustion engine, exactly the same amount of fuel is fed into the internal combustion engine for the combustion process, as can be combusted with the amount of air fed into said internal combustion engine for the combustion process. In this context, quasi-stoichiometric means that the air-to-fuel ratio of the air-to-fuel mixture is stoichiometric at a predetermined low tolerance.

In an advantageous embodiment of the method, the value of the operating variable is determined anew and/or newly tested and/or changed over to lean operation after the changeover to quasi-stoichiometric operation only after a specified length of time. In that way, it is possible for the changeover to the quasi-stoichiometric operation to first have an effect on the internal combustion engine the changeover to lean operation once again. This contributes to a precise operation of the internal combustion engine and prevents reverting to lean operation too quickly.

In a further advantageous embodiment of the method, in the case of each changeover to quasi-stoichiometric operation, a counter is incremented by one unit because of the implausible value of the operating variable. This makes it possible to record the changeover frequency between lean operation and quasi-stoichiometric operation of the internal combustion engine.

In a further advantageous embodiment of the method, a changeover to lean operation is only carried out if the counter is below a specified maximum value of the counter. This for example makes it possible to avoid an error condition which is generated on the basis of the lean operation of the internal combustion engine.

In a further advantageous embodiment of the method, a value of a dispensed amount of fuel is determined as a function of the first measured quantity. A test is carried out to determine whether or not the value of the amount of fuel dispensed is plausible as a function of the second measured quantity. A changeover to quasi-stoichiometric operation is carried out if the value of the amount of fuel dispensed is not plausible. The value of the amount of fuel dispensed is determined anew and tested anew. A changeover to lean operation is carried out if the newly determined value of the amount of fuel dispensed is plausible. This in particular contributes to a precise operation of the internal combustion engine because, especially during the operation of the internal combustion engine in lean operation, a larger amount of fuel can contribute to the fluctuation in the generated torque.

In a further advantageous embodiment of the method, a ratio value of the air-to-fuel mixture is determined as a function of the first measured quantity and at least of a third measured quantity. The ratio value of the air-to-fuel mixture is representative of the air-to-fuel ratio of the air-to-fuel mixture. A test is carried out to determine whether or not the ratio value of the air-to-fuel mixture is plausible. A changeover to quasi-stoichiometric operation takes place if the ratio value of the air-to-fuel mixture is not plausible. The ratio value of the air-to-fuel mixture is determined anew and tested anew. If the newly determined ratio value of the air-to-fuel mixture is plausible, a changeover to lean operation is implemented. This contributes to an exact operation of the internal combustion engine, because especially during the operation of an internal combustion engine with a lean air-to-fuel mixture, it is precisely an air-to-fuel ratio shifted in favor of the amount of fuel which contributes to a fluctuation in the generated torque.

The advantageous embodiments of the method can easily be transferred to advantageous embodiments of the device.

BRIEF DESCRIPTION OF THE DRAWINGS

The invention is explained in detail below with reference to schematic drawings.

They are as follows.

Elements with the same design or function are labeled in all the figures with the same reference symbols.

DETAILED DESCRIPTION OF INVENTION

Figure 1:
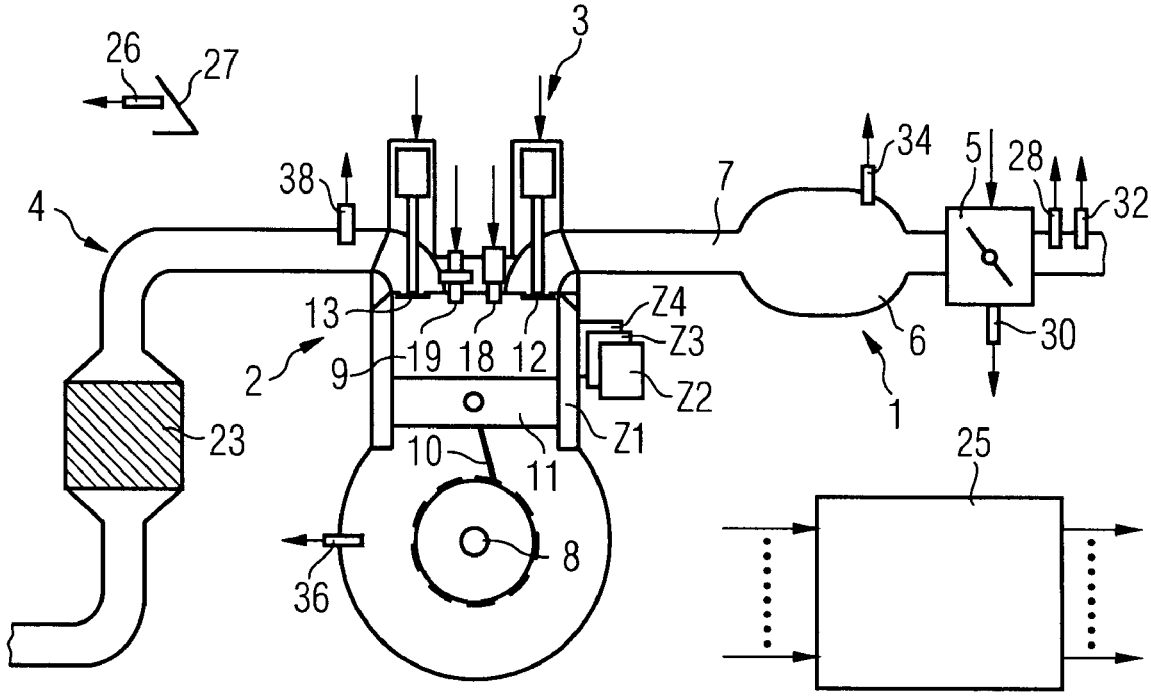
FIG. 1 a schematic diagram of an internal combustion engine.

An internal combustion engine comprises an intake tract 1, an engine block 2, a cylinder head 3 and an exhaust gas tract 4. The intake tract 1 preferably comprises a throttle valve 5, a manifold 6 and an intake pipe 7, which is routed to a cylinder Z1 via an intake port in a combustion chamber 9 in an engine block 2. The engine block 2 also comprises a crankshaft 8 that is connected to piston 11 of a cylinder Z1 by means of a connecting rod 10. The internal combustion engine preferable comprises in addition to the cylinder Z1 additional cylinders Z1-Z4. The internal combustion engine is preferably arranged in a motor vehicle.

The cylinder head 3 also preferably includes both an injection valve 18 and a spark plug 19. Alternatively, the injection valve 18 can also be arranged accordingly in the intake pipe 7. The exhaust gas tract 4 preferably includes an exhaust gas catalytic converter 23, which is preferably embodied as a three-way catalytic converter.

A control device 25 is provided to which sensors have been allocated, said sensors detecting the different measured quantities and in each case determining the value of the measured quantity. Operating variables include the measured quantities and quantities of the internal combustion engine derived from these. Operating variables can be representative of the current operating condition of the internal combustion engine. The control device 25 determines, as a function of at least one of the operating variables, at least one controlling variable, which is then converted into one adjusting signal or a plurality of adjusting signals for controlling the final control elements by means of corresponding actuators. The control device 25 can also be referred to as a device for controlling an internal combustion engine.

The sensors are a pedal position indicator 26 which detects the position of a gas pedal 27, an air mass flow meter 28 which detects an air mass flow upstream of the throttle valve 5, a temperature sensor 32 which detects the intake air temperature, an intake pipe pressure sensor 34 which detects the intake pipe pressure in a manifold 6, a crankshaft angle sensor 36 which detects a crankshaft angle to which a rotational speed of the internal combustion engine is then allocated. In addition, provision has also been made for an exhaust sensor 38, which is arranged upstream of the exhaust gas catalytic converter 23 and which, for example, detects a residual oxygen content of the exhaust gas and the measuring signal of which is characteristic of an air-to-fuel ratio in the combustion chamber 9 of cylinders Z1-Z4.

Depending on the embodiment of the invention, there can be any subset of the mentioned sensors or there can even be additional sensors.

The final control elements are, for example, the throttle valve 5, the gas intake and the gas discharge valves 12, 13, the injection valve 18 and/or the spark plug 19.

Lean operation AFL of the internal combustion engine is characterized in that a smaller amount of fuel is fed in for the combustion process of the internal combustion engine than can be combusted with the amount of air fed in for the combustion process, in particular with the oxygen contained therein.

During stoichiometric operation of the internal combustion engine, exactly the same amount of fuel that can be combusted with the oxygen is fed in for the combustion process. In this context, quasi-stoichiometric means that the air-to-fuel ratio is stoichiometric at a preferably predetermined low tolerance. For example, during the quasi-stoichiometric operation, preferably within a very small range around the stoichiometric air-to-fuel ratio, lean operation AFL and rich operation of the internal combustion engine are alternated. In principle, the quasi-stoichiometric operation can also be referred to as stoichiometric operation.

In lean operation AFL, an opening degree of the throttle valve 5 is adjusted to the maximum and an engine load is preferably adjusted by means of an amount of fuel MFF to be dispensed. On the other hand, during the quasi-stoichiometric operation, the load of the internal combustion engine is preferably adjusted by means of the opening degree of the throttle valve 5. The opening degree of the throttle valve 5 acts on a mass air flow MAF through to the combustion chamber 9. An efficiency of the internal combustion engine is higher than that achieved during the quasi-stoichiometric operation AFS owing to the unthrottled mass air flow MAF in lean operation AFL through to the combustion chamber. However, in lean operation AFL, the internal combustion engine is more prone to error conditions. These error conditions can be generated by the unexpected values of command variables, which are operating variables, for example an unexpected fuel pressure, an unexpectedly large amount of metered fuel MFF and/or an unexpected air-to-fuel ratio in favor of the amount of fuel dispensed MFF that can be generated by the unexpectedly large amount of fuel MFF. The unexpectedly large amount of metered fuel MFF or the unexpected air-fuel ratio can for example be generated by a tank aeration and/or a crankshaft housing aeration, through which the fuel fumes from a fuel tank or from a crankshaft housing of the internal combustion engine can reach the intake tract 1 and/or the combustion chamber 9 and/or the exhaust gas tract 4.

When an error condition occurs, a bit is set in an error memory on a storage medium of the control unit 25 in a preferred manner. This bit is then representative of the occurrence of the error condition, in particular for the presence of the implausible operating variables. In lean operation, in order to test the operating variable, a test can then be carried out to determine whether or not the bit has been set.

In lean operation, the unexpectedly amount of fuel dispensed MFF or the unexpected air-to-fuel ratio acts directly on a torque generated by the internal combustion engine, because on the basis of lean operation AFL there is sufficient oxygen in the internal combustion engine in order to combust the unexpectedly large amount of fuel MFF. During quasi-stoichiometric operation, the unexpectedly large amount of fuel MFF or the unexpected air-to-fuel ratio no longer acts so strongly on the generated torque as it does in lean operation AFL, because hardly any oxygen or no oxygen at all has been provided for the combustion of the unexpectedly large amount of fuel MFF.

When testing whether or not a value of any operating variable is plausible PLAUS, for example a value of the amount of fuel MFF to be dispensed, the value of any operating variable is preferably determined by means of a model calculation on the basis of a first measured quantity of the internal combustion engine. A check value of any operating variable is then preferably determined as a function of a second measured quantity. Subsequently, the value and the check value of any operating variable can be compared with one another. For example, a tolerance band can be specified as a function of the value of any operating variable and a test can be carried out to determine whether or not the check value of any operating variable lies within the tolerance band. Alternatively, the tolerance band can be predetermined by the check value of any operating variable and a test can be carried out to determine whether or not the value of any operating variable lies within the tolerance band. Alternatively, the tolerance band can be specified as a function of the first and/or the second measured quantity and a test can be carried out to determine whether or not the value of any operating variable lies within the tolerance band. During the operation of the internal combustion engine, the value and the check value or the tolerance band of any operating variable is preferably determined continuously and used for mutual plausibility.

Figure 2:
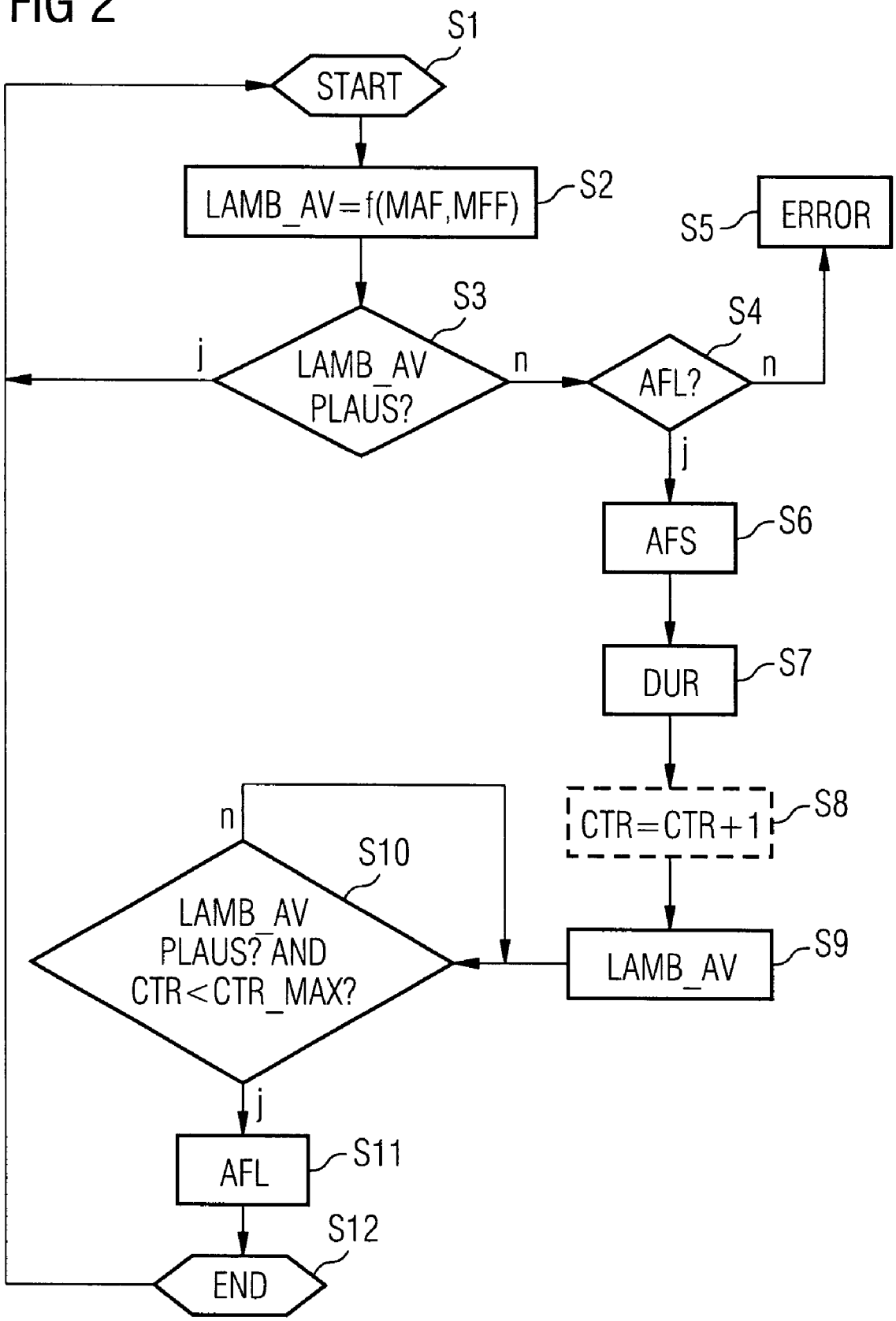
FIG. 2 a flowchart of a program for operating an internal combustion engine.

A program (FIG. 2) for operating an internal combustion engine is preferably stored on a storage medium of the control unit 25. The program is used in the case of an implausible value of the operating variable, in particular in the case of an implausible value LAMB_AV of the air-to-fuel ratio, to prevent or limit a fluctuation in the torque of the internal combustion engine and nevertheless to operate the internal combustion engine at a fuel consumption that is as low as possible. The program is preferably started in a step S1, in which variables are initialized, if required.

In a step S2, the value LAMB_AV of the air-to-fuel ratio is determined as a function of the mass air flow MAF up to the combustion chamber 9 and as a function of the metered mass air flow MFF. The mass air flow MAF up to the combustion chamber 9 can for example be determined as a function of the mass air flow upstream of the throttle valve 5 and as a function of the opening degree of the throttle valve 5. The amount of fuel dispensed MFF can for example be selected on the basis of a desired value of the amount of fuel dispensed MFF and/or determined as a function of the duration of an activation of the injection valve 18 and/or as a function of a fuel pressure by means of which the fuel is metered by means of the injection valve 18.

In a step S3, a test is carried out to determine whether or not the value LAM_AV of the air-to-fuel ratio is plausible PLAUS and preferably as a function of a measuring signal of the exhaust gas sensor 38. If the condition of a step S3 has been met, the process is continued once more in a step S1. If the condition of a step S3 has not been met, the process is continued in a step S4.

In a step S4, a test is carried out to determine whether or not the internal combustion engine is currently being operated in lean operation. If the condition of a step S4 has not been met, an error measure ERROR is initiated. If the condition of a step S4 has been met, the process is continued in a step S6. In a step S6, a changeover to quasi-stoichiometric operation AFS of the internal combustion engine takes place.

The program then remains in a step S7 for a specified length of time DUR.

In a step S8, a counter CTR can be incremented by one unit.

In a step S9, the value LAMB_AV of the air-to-fuel ratio is determined anew.

In a step S10, a test is carried out to determine whether or not the newly determined value LAMB_AV of the air-to-fuel ratio is plausible PLAUS and whether or not the counter CTR is below a maximum CTR MAX value of the counter CTR. This can contribute to preventing, an error, which is for example generated on the basis of lean operation AFL of the internal combustion engine, from being generated time and again by changing over to lean operation AFL.

In a step S11, a changeover to lean operation AFL takes place.

The program can end in a step S12. However, the program is preferably ended at regular intervals during the operation of the internal combustion engine.

The invention is not limited to the given examples of the invention. For example, in the program, as an alternative to the value LAMB_AV of the air-to-fuel ratio, a different operating variable of the internal combustion chamber can be determined and tested, for example, the amount of fuel dispensed MFF.

The invention claimed is:

1. A method to operate an internal combustion engine, comprising:

providing an intake tract that communicates with a combustion chamber of a cylinder of the internal combustion engine based upon a position of a gas intake valve;

providing a final control element in the intake tract to specify a mass air flow up to the combustion chamber;

providing an injection valve for metering a fuel allocated to the cylinder;

determining a value of an operating variable of the internal combustion engine based upon a first measured quantity of the internal combustion engine;

determining if the value of the operating variable is reasonable depending on a second measured quantity of the internal combustion engine;

determining if the internal combustion engine is operated in a lean operation when the value of the operating variable is not reasonable;

changing the operation of the internal combustion engine to a quasi-stoichiometric operation of the internal combustion engine when the internal combustion engine is operated in lean operation and when the value of the operating variable is not reasonable;

redetermining the value of the operating variable of the internal combustion engine based upon the first measured quantity of the internal combustion engine and determining if the redetermined value of the operating variable is reasonable depending on a remeasured second measured quantity of the internal combustion engine in response to the changeover to the quasi-stoichiometric operation; and changing the operation to the lean operation if the newly determined value of the operating variable is reasonable.

2. The method as claimed in claim 1, wherein the final control element is an actuator.

3. The method as claimed in claim 1, wherein the value of the operating variable is redetermined after a specified length of time after changing over to the quasi-stoichiometric operation.

4. The method as claimed in claim 1, wherein the plausibility of a measured operating variable is redetermined after a specified length of time after changing over to the quasi-stoichiometric operation.

5. The method as claimed in claim 1, wherein a change over to the lean operation after changing over to the quasi-stoichiometric operation is performed after a specified length of time.

6. The method as claimed in claim 1, wherein for each changeover to the quasi-stoichiometric operation based on a unreasonable operating value, a counter is incremented by one unit.

7. The method as claimed in claim 6, wherein the changeover to the lean operation is only carried out if the counter is below a specified maximum value.

8. The method as claimed in claim 1, further comprising:

determining a value of an amount of fuel dispensed based upon the first measured quantity, determining whether the value of the amount of fuel dispensed is reasonable based upon the second measured quantity, changing the operation over to the quasi-stoichiometric operation if the value of the amount of fuel dispensed is unreasonable.

9. The method as claimed in claim 8, farther comprising redetermining the value of the amount of fuel dispensed, redetermining whether the value of the amount of fuel dispensed is reasonable based upon the second measured quantity, changing the operation over to lean operation if the newly determined value of the amount of fuel dispensed is reasonable.

10. The method as claimed in claim 1, further comprising:

determining a ratio value of an air-to-fuel mixture, wherein the ratio value of the air-to-fuel mixture is representative of the air-to-fuel ratio of the air-to-fuel mixture, depending on the first measured quantity and at least of a third measured quantity, determining whether the ratio value of the air-to-fuel mixture is reasonable, changing over operation to the quasi-stoichiometric operation if the ratio value of the air-to-fuel mixture is unreasonable.

11. The method as claimed in claim 10, further comprising:

redetermining the ratio value of the air-to-fuel mixture, redetermining if the ratio value of the air-to-fuel mixture is reasonable, changing over operation to lean operation if the newly determined ratio value of the air-to-fuel mixture is reasonable.

12. A device for operating an internal combustion engine, comprising:

an intake tract that communicates with a combustion chamber of a cylinder of the internal combustion engine based upon a position of a gas intake valve;

a final control element in the intake tract to throttle a mass air flow in the combustion chamber;

an injection valve for metering a fuel allocated to the cylinder;

a first value of an operating variable of the internal combustion engine based upon a first measured quantity of the internal combustion engine;

a first test result, wherein the value of the operating variable is tested on plausibility based upon a second measured quantity of the internal combustion engine;

a check result if the value of the operating variable is unreasonable, wherein it is checked whether the internal combustion engine is currently being operated in lean operation;

a changeover command to quasi-stoichiometric operation of the internal combustion engine, if the internal combustion engine is operated in lean operation, a second value of an operating variable of the internal combustion engine based upon the first measured quantity of the internal combustion engine if the operation is switched to the quasi-stoichiometric operation, a second test result, wherein the value of the operating variable is tested on plausibility based upon a second measured quantity of the internal combustion engine, if the operation is switched to the quasi-stoichiometric operation, and a change over to lean operation if the newly determined value of the operating variable is reasonable.

* * * * *